US007331845B2

(12) United States Patent
Imai et al.

(10) Patent No.: US 7,331,845 B2
(45) Date of Patent: Feb. 19, 2008

(54) DOUBLE END FACE TRUING DEVICE, DOUBLE END FACE TRUING TOOL, AND DOUBLE END FACE TRUING METHOD

(75) Inventors: Tomoyasu Imai, Okazaki (JP); Noboru Hiraiwa, Okazaki (JP); Shinji Soma, Osaka (JP)

(73) Assignees: Toyoda Van Moppes Ltd., Okazaki-shi (JP); JTEKT Corporation, Osaka-shi (JP)

( * ) Notice: Subject to any disclaimer, the term of this patent is extended or adjusted under 35 U.S.C. 154(b) by 0 days.

(21) Appl. No.: 10/588,319

(22) PCT Filed: Feb. 17, 2005

(86) PCT No.: PCT/JP2005/002942

§ 371 (c)(1),
(2), (4) Date: Aug. 3, 2006

(87) PCT Pub. No.: WO2005/077600

PCT Pub. Date: Aug. 25, 2005

(65) Prior Publication Data

US 2007/0128986 A1 Jun. 7, 2007

(30) Foreign Application Priority Data

Feb. 18, 2004 (JP) ..... 2004-041958

(51) Int. Cl.
*B24B 1/00* (2006.01)

(52) U.S. Cl. ..... 451/56; 451/443; 451/541

(58) Field of Classification Search ..... 451/56, 451/443, 541, 178, 180, 252, 254
See application file for complete search history.

(56) References Cited

U.S. PATENT DOCUMENTS 4,953,522 A * 9/1990 Vetter ..... 125/11.01

(Continued)

FOREIGN PATENT DOCUMENTS

DE 38 11 784 7/1989

(Continued)

*Primary Examiner*—Eileen P. Morgan
(74) *Attorney, Agent, or Firm*—Oblon, Spivak, McClelland, Maier & Neustadt, P.C.

(57) ABSTRACT

First and second end surface truing sections are formed by protruding cylindrical first and second base bodies from opposite end surfaces of a disc-like base of an opposite end surface truing tool in the axial direction thereof and by providing on the external surface of the first base body and the internal surface of the second base body first and second abrasive grain layers in which numerous diamond abrasive grains are adhered with bond material. The rotational axis of the opposite end surface truing tool is inclined relative to the rotational axis of the grinding wheel within almost the same plane at a predetermined inclination angle. By moving the opposite end surface truing tool toward the rotational axis of the grinding wheel, the first and second abrasive grain layers respectively true the grinding surfaces at the opposite ends of the grinding wheel under almost the same condition to sharp grinding surfaces having moderate ruggedness, as they go ahead of the first and second base bodies to be backed up thereby. Consequently, it can be realized to true the grinding surfaces at the opposite ends of the grinding wheel under almost the same condition to the sharp grinding surfaces having the moderate ruggedness.

12 Claims, 5 Drawing Sheets

U.S. PATENT DOCUMENTS

| | | | | |
|---|---|---|---|---|
| 5,531,635 | A * | 7/1996 | Mogi et al. | 451/72 |
| 2002/0045404 | A1* | 4/2002 | Cantoro | 451/8 |

FOREIGN PATENT DOCUMENTS

| | | |
|---|---|---|
| JP | 08-090411 | 4/1996 |
| JP | 2001-179625 | 7/2001 |
| JP | 2002-239904 | 8/2002 |
| JP | 2005-081488 | 3/2005 |

* cited by examiner

DOUBLE END FACE TRUING DEVICE, DOUBLE END FACE TRUING TOOL, AND DOUBLE END FACE TRUING METHOD

TECHNOLOGICAL FIELD

The present invention relates to an opposite end surface truing device, an opposite end surface truing tool and an opposite end surface truing method for truing grinding surfaces at the opposite ends of a grinding wheel.

BACKGROUND ART

As an opposite end surface truing tool used in an opposite end surface truing device for truing grinding surfaces at opposite ends of a grinding wheel, there has been known one wherein cylindrical truing sections each having diamond abrasive grains bonded thereon with a metal-base bond material (metal bond) are coaxially fixed on the external surface of a disc-like base rotatable about a rotational axis, as described in Japanese Unexamined, Published Patent Application No. 8-90411. As shown in FIGS. 2 and 3 of the Patent Application No. 8-90411, the opposite end surface truing tool is constructed to protrude the cylindrical truing sections 38, 39 each rectangular in cross-section from opposite end surfaces at circumferential portions of the base 36, and a wheel truing tool 35 as the opposite end surface truing tool is used to be mounted on the opposite end surface truing device with the rotational axis O2 thereof being inclined (inclination angle: 8 degrees for example) relative to the rotational axis O1 of a grinding wheel 21 which is provided with a grinding wheel layer 23 on the external surface of a grinding wheel core 22. The truing of a grinding surface 23*b* on one end of the grinding wheel layer 23 of the grinding wheel 21 with the second truing section 38 of the wheel truing tool 35 is carried out as indicated by the two-dot-chain line 21B in FIG. 3 by moving the wheel truing tool 35 in a Z-direction to infeed the second truing section 38 against the grinding surface 23*b* and then by moving the wheel truing tool 35 toward the rotational axis O1 in an X-direction, while the truing of a grinding surface 23*c* on the other end with the third truing section 39 is carried out as indicated by the solid line 21C in FIG. 3 by moving the wheel truing tool 35 in the Z-direction to infeed the third truing section 39 against a grinding surface 23*c* and then by moving the wheel truing tool 35 toward the rotational axis O1 in the X-direction.

In the foregoing prior art technology, since the spaces among the diamond abrasive grains are filled with the metal bond in a state that pores do not open, the diamond abrasive grains and metal bond at each of the truing sections 38, 39 become even in height, so that the diamonds not protruding cannot be cut into the grinding wheel sufficiently. Further, because the diamond abrasive grains are only mechanically embeded in the metal bond, but not joined chemically, the retention force for the abrasive grains is weak, and the diamond abrasive gains are easy to fall off the metal bond, thereby resulting in a decrease in the number of the abrasive grains which work to true the grinding surfaces 23*b*, 23*c* at the opposite ends of the grinding wheel 21. After trued with the wheel truing tool 35, the grinding surfaces 23*b*, 23*c* of the grinding wheel 21 become flat and dull, and where used for grinding, the grinding wheel 21 causes the grinding resistance to increase and is unable to secure the grinding efficiency and the surface quality as desired.

Further, the grinding surfaces 23*b*, 23*c* at the opposite ends are flat, and by inclining the rotational axis of the wheel truing tool 35 relative to the rotational axis of the grinding wheel 21, the edge portions of the truing sections 38, 39 at the opposite ends of the wheel truing tool 35 are made to contact with the grinding surfaces 23*b*, 23*c* at arc shapes. However, the contact length of each truing section 38, 39 with the grinding surface 23*b*, 23*c* is elongated to increase the truing resistance, so that it is unable for the diamond abrasive grains at each truing section 38, 39 to sufficiently crush CBN abrasive grains on each grinding surface 23*b*, 23*c*.

Furthermore, because the wheel truing tool 35 is constituted to protrude the cylindrical truing sections 38, 39, made by binding diamond abrasive grains with the metal bond, from opposite end surfaces at the circumferential portions of the base 36 in the axial direction of the rotational axis, it is impossible from the standpoints of manufacturing and strength to make the depth in radial direction of each cylindrical truing section 38, 39 thin. This makes the contact area of each truing section 38, 39 with the grinding surface 23*b*, 23*c* large to increase the truing resistance, so that each grinding surface 23*b*, 23*c* cannot be trued sharply.

Furthermore, a research has been made of forming the second and third truing sections 38, 39 by bodily protruding cylindrical bodies from the opposite end surfaces of the base 36 in the axial direction and by binding diamond abrasive grains on the external surface of each cylindrical body as one layer or a thin layer. However, when the third truing section 39 of the opposite end surface truing tool is used to true the grinding surface 23*c* at the other end of the grinding wheel 21, the cylindrical body comes into contact with the grinding surface 23*c* earlier than the diamond abrasive grain layer does. This causes the truing resistance to increase and the diamond abrasive layer to lack the rigidity against the truing resistance for the reason of being not backed up by the base body, so that it is unable to true the grinding surface 23*c* into a sharp grinding surface having moderate ruggedness.

The present invention solves the foregoing programs and is designed to make it possible that grinding surfaces at opposite ends of a grinding wheel can be trued under almost the same condition into sharp grinding surfaces having moderate ruggedness.

DISCLOSURE OF THE INVENTION

Briefly, the present invention provides an opposite end surface truing tool for truing opposite end surfaces of a grinding wheel, an opposite end surface truing device which uses the opposite end surface truing tool in truing the opposite end surfaces of the grinding wheel, and an opposite end surface truing method which is implemented by using the opposite end surface truing tool for truing opposite end surfaces of the grinding wheel. The opposite end surface truing tool comprises a first end surface truing section composed of a cylindrical first base body which protrudes bodily from a circumferential portion at one end surface of a disc-like base coaxially with the rotational axis of the same and a first abrasive grain layer in which numerous diamond abrasive grains are adhered with bond material to an external surface of the first base body. The truing tool further comprises a second end surface truing section composed of a cylindrical second base body which protrudes bodily from a circumferential portion at the other end surface of the base coaxially with the rotational axis and a second abrasive grain layer in which numerous diamond abrasive grains are adhered with bond material to an internal surface of the second base body. The rotational axis of the opposite end surface truing tool is inclined relative to the rotational axis of the grinding wheel within almost the same plane at a predetermined inclination angle.

With this construction, the first and second end surface truing sections are formed by protruding the cylindrical first and second base bodies respectively from opposite end surfaces of the disc-like base of the opposite end surface truing tool in the axial direction thereof and by proving on the external surface of the first base body and the internal surface of the second base body the first and second abrasive grain layers in which the numerous diamond abrasive grains are adhered with the bond material, and the rotational axis of the opposite end surface truing tool is inclined relative to the rotational axis of the grinding wheel within almost the same plane at the predetermined inclination angle. Thus, by moving the opposite end surface truing tool toward the rotational axis of the grinding wheel, it can be realized that the first and second abrasive grain layers can respectively true the grinding surfaces at the opposite ends of the grinding wheel under almost the same condition to the sharp grinding surfaces having moderate ruggedness, while retaining a sufficient rigidity against the truing resistance as they go ahead of the first and second base bodies to be backed up thereby.

PREFERRED EMBODIMENTS TO PRACTICE THE INVENTION

Figure 1:
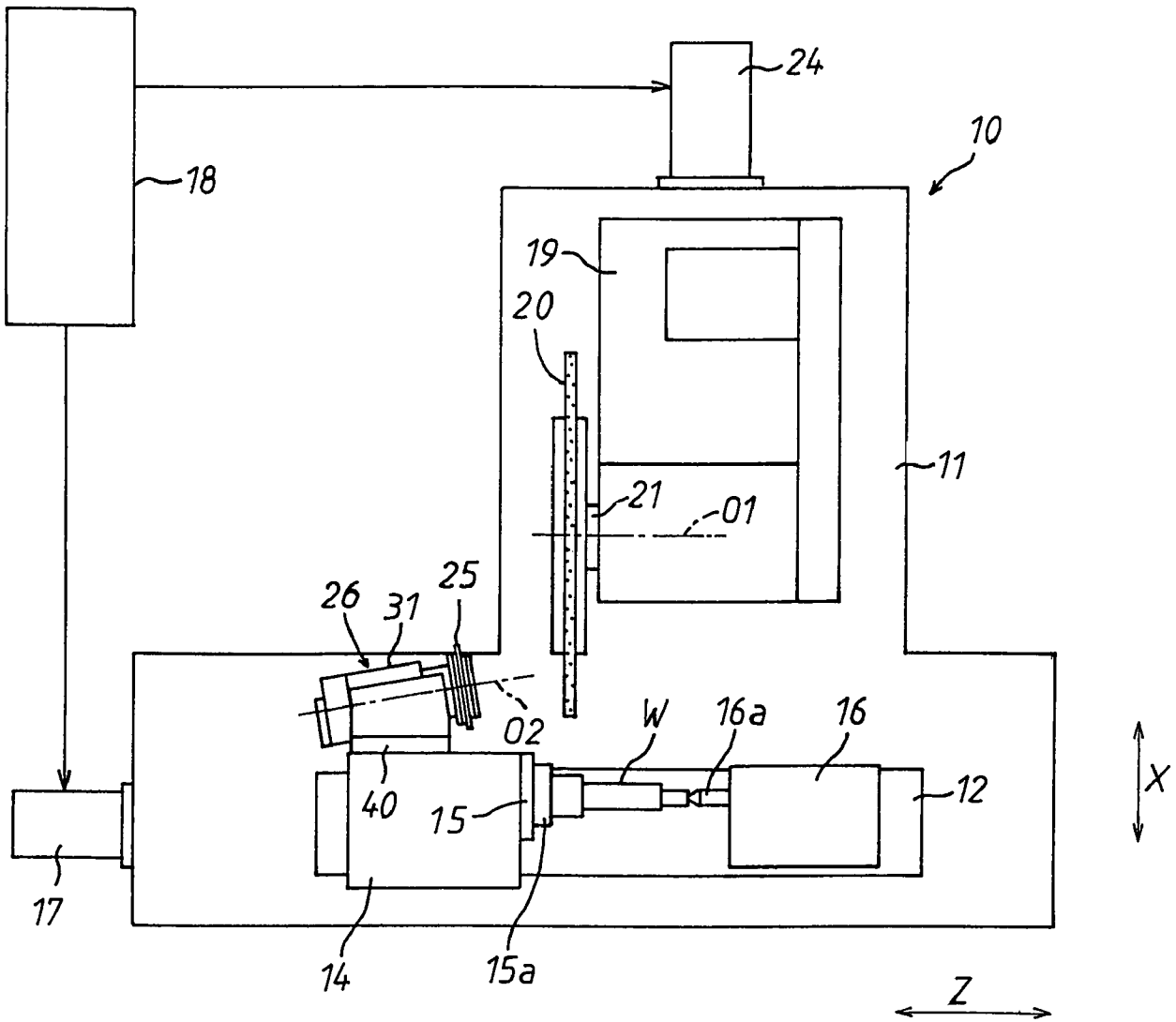
FIG. 1 is a plan view of a grinding machine provided with an opposite end surface truing device in the first embodiment according to the present invention.
Figure 2:
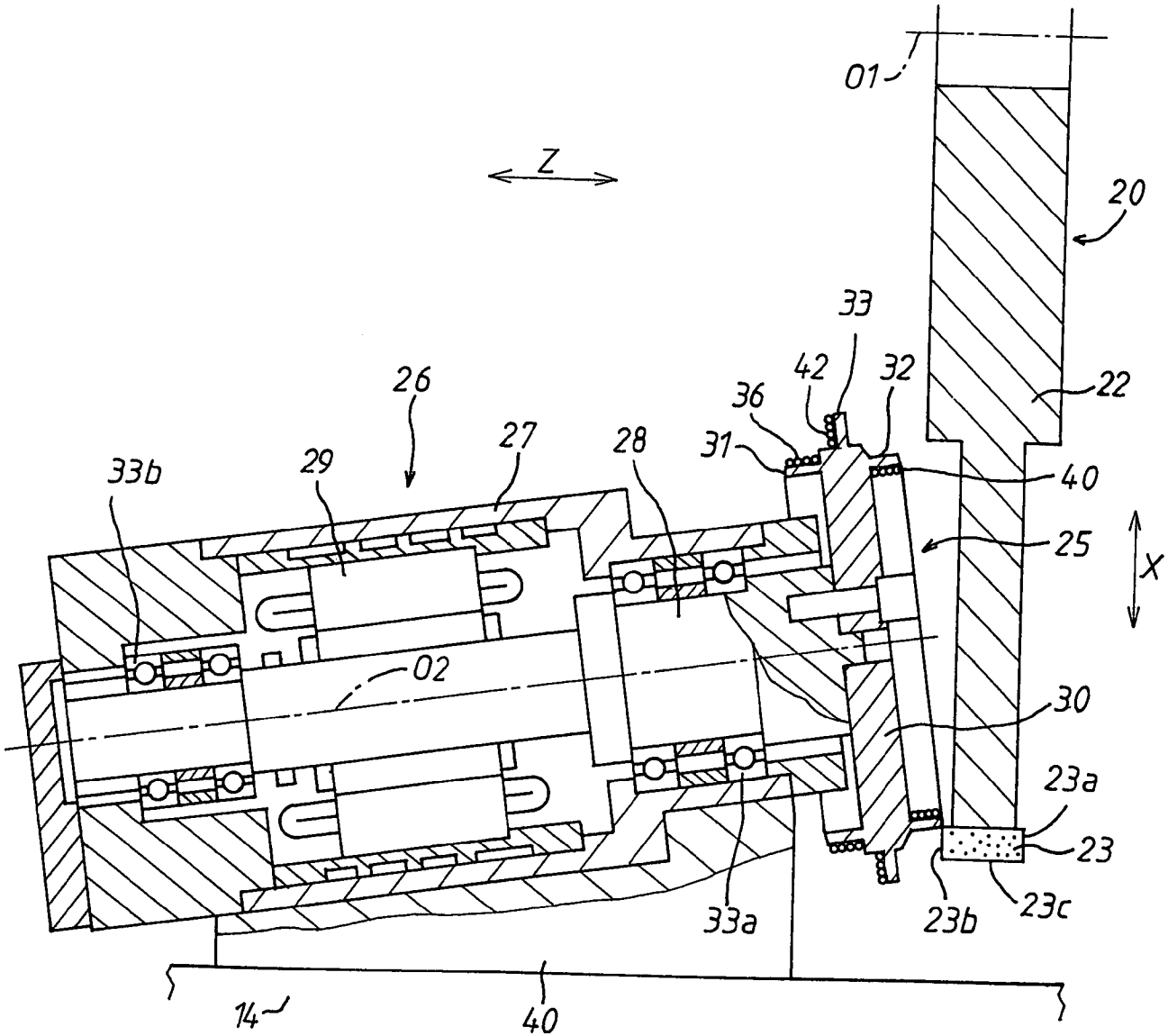
FIG. 2 is a sectional view of a truing tool support device in the first embodiment.

Hereafter, embodiments of an opposite end surface truing device, an opposite end surface truing tool and an opposite end surface truing method according to the present invention will be described with reference to the drawings. As shown in FIGS. 1 and 2, on a workpiece table 12 which is guided and supported on a bed 11 of a grinding machine 10 to be movable in a horizontal left-right direction (Z-direction, first direction), a work head 14 rotatably carrying a work spindle 15 and a foot stock 16 are provided coaxially to face with each other in the left-right direction, and a workpiece W is gripped at its one end by a chuck 15*a* provided on the work spindle 15 and is sustained at the other end by a center provided on the foot stock 16. The work spindle 15 is rotationally driven by a motor provided in the work head 14, so that the workpiece W gripped by the chuck 15*a* is rotated together with the work spindle 15. A servomotor 17 provided on the bed 11 is drivingly controlled by a drive circuit (not shown) which operates in response to control pulses given from a numerical controller 18, and feeds the workpiece table 12 in the Z-direction through a feed screw (not shown). The position in the Z-direction of the workpiece table 12 is detected by an encoder to be inputted to the numerical controller 18.

The bed 11 mounts thereon a wheel head 19, which is guided and supported movably in a horizontal X-direction (second direction) perpendicular to the Z-direction, and a grinding wheel 20 is rotatably carried on the wheel head 19 through a wheel spindle 21 having a rotational axis O1 parallel to the Z-direction. The grinding wheel 20 is rotationally driven by a motor through a V-belt rotation transmission mechanism (not shown) or the like. The grinding wheel 20 is constituted by providing a grinding wheel layer 23, in which CBN abrasive grains are bound with vitrified bond, on an external surface of a disc-like wheel core 22 made of a metal, and the grinding wheel layer 23 has formed grinding surfaces 23*a*, 23*b* at opposite ends thereof and has also formed another grinding surface 23*c* at an external surface thereof. A servomotor 24 provided on the bed 11 is drivingly controlled by a drive circuit (not shown) which operates in response to control pulses applied from the numerical controller 18, and feeds the wheel head 19 in the X-direction through a feed screw (not shown). The position in the X-direction of the wheel head 19 is detected by an encoder to be inputted to the numerical controller 18.

A truing tool support device 26 with a rotating truing tool 25 is attached to the work head 14 on the side close to the wheel head 19. A truer spindle 28 is rotatably supported in a main body 27 of the truing tool support device 26, fixed on the work head 14, through bearings to be rotationally driven by a built-in motor 29, and the opposite end surface truing tool 25 for truing the grinding wheel 20 is coaxially secured to an end of the truer spindle 28 protruding from the main body 27. The rotational axis of the truer spindle 28 lies within a horizontal plane including the rotational axis of the wheel spindle 21, and on its extension line extending in a direction opposite to the main body 27 and the truer spindle 28, the rotational axis O2 of the opposite end surface truing tool 25 intersects with the rotational axis O1 of the grinding wheel 22 to incline at a predetermined angle, e.g., 8 degrees in the present embodiment.

Figure 6:
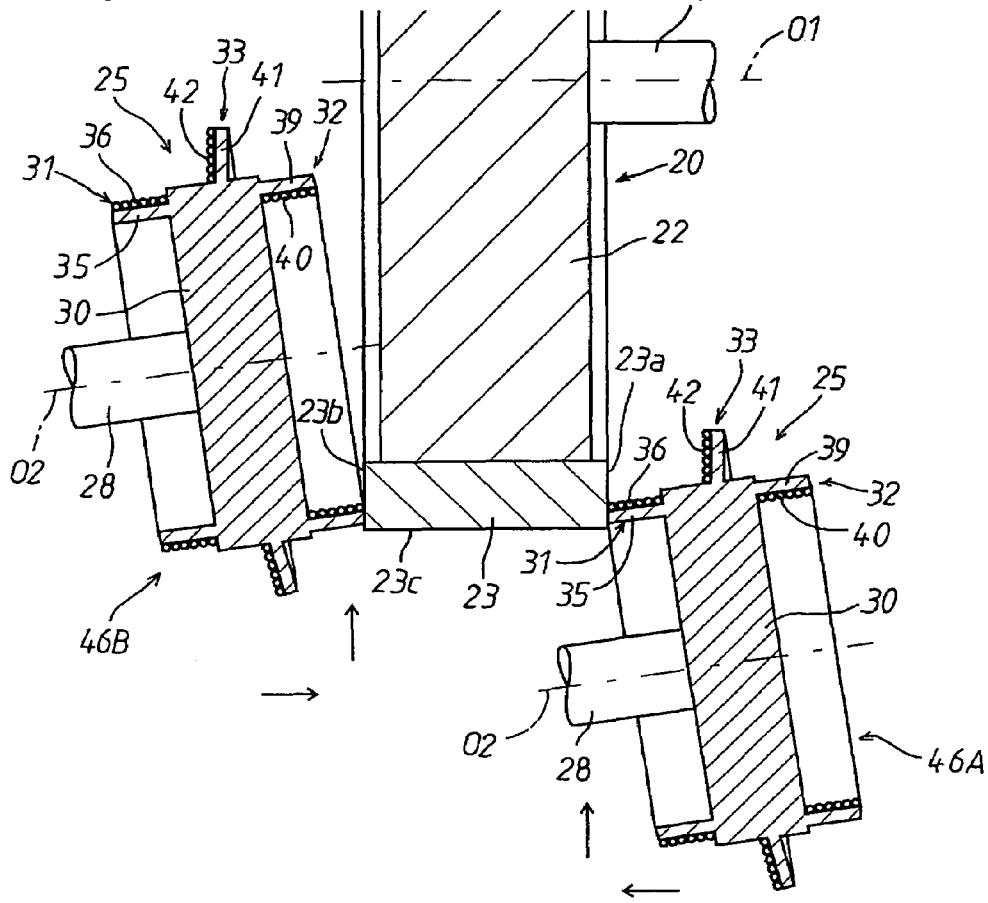
FIG. 6 is a representation showing the state that grinding surfaces at opposite ends of a grinding wheel are being trued.
Figure 7:
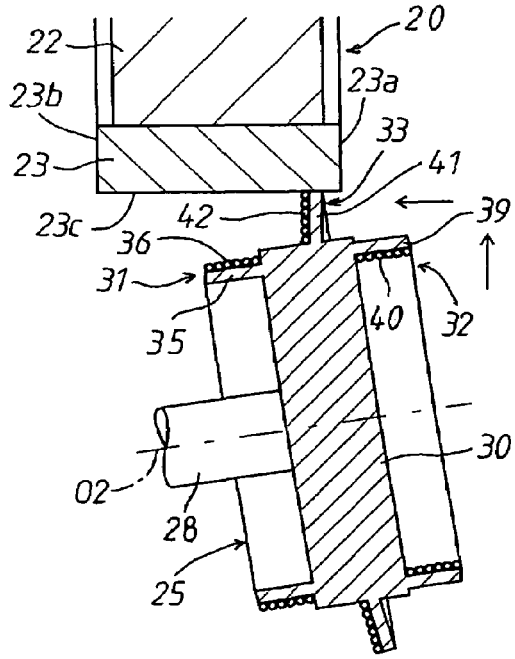
FIG. 7 is a representation showing the state that a circumferential grinding surface of the grinding wheel is being trued.

As shown in FIGS. 2, 6 and 7, the opposite end surface truing tool 25 is composed of a disc-like base 30 rotatable about the rotational axis O2 and first and second end surface truing sections 31, 32 protruding from the circumferential portions at the opposite end surfaces of the base 30 coaxially almost in parallel to the rotational axis O2 and each taking a cylindrical shape. The opposite end surface truing tool 25 in the present embodiment is provided with a circumferential surface truing section 33 protruding from the external surface of the base 30 almost perpendicularly to and coaxially with the rotational axis O2 and taking an almost disc-like shape.

Figure 3:
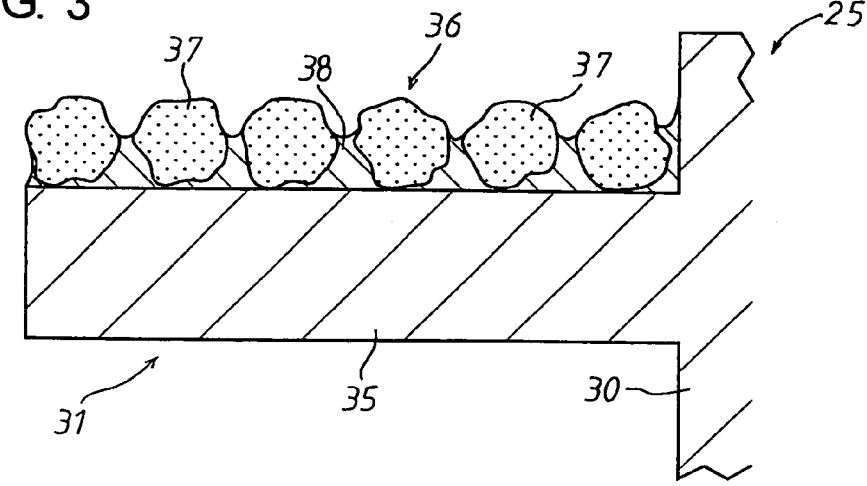
FIG. 3 is an enlarged fragmentary sectional view showing a first end surface truing section of an opposite end surface truing tool.

As shown in FIGS. 3 and 6, the first end surface truing section 31 formed at the left end surface of the base 30 is composed of a first base body 35 and a first abrasive grain layer 36 of an approximately constant depth which is brazed bodily on the first base body 35. The first base body 35 takes a cylindrical shape which is formed coaxially and bodily with the base 30 made of steel, and protrudes from a slightly inner portion of the left end surface than the external surface of the base 30. The thickness and length of the first base body 35 are small in comparison with those dimensions of the base 30. The first abrasive grains layer 36 is of the construction that numerous diamond abrasive grains 37 are brazed with a brazing material 38 which in the melting state has a strong affinity for diamond, and is brazed on the first base body 35 with the same brazing material 38.

The second end surface truing section 32 formed at the right end surface of the base 30 is composed of a second base body 39 and a second abrasive grain layer 40 and is almost the same as the first end surface truing section 31 except for the respects that the second base body 39 is a little larger in the outer diameter than the first base body 35 and that the second abrasive grain layer 40 is brazed on the internal surface of the second base body 39. The circumferential surface truing section 33 formed on the external surface of the base 30 is constituted by brazing a third abrasive grain layer 42, similar to the first and second abrasive grain layers 36 and 40, bodily on the left end surface of a third base body 41 which is formed coaxially and bodily with the base 30 to take an almost disk-like shape. The third base body 41 takes a cone shape whose vertex angle is large (e.g., the half vertex angle made with the rotational axis O2 is eighty two (82) degrees). The respective base bodies 35, 39 and 41 can be formed bodily with the base 30 by cutting or can be formed by sintering or the like. Alternatively, those formed separately may be joined bodily with the base 30 by brazing or the like. Further, in each of the abrasive grain layers 36, 40, 42, the diamond abrasive grains 37 are brazed to form a single layer.

Figure 4:
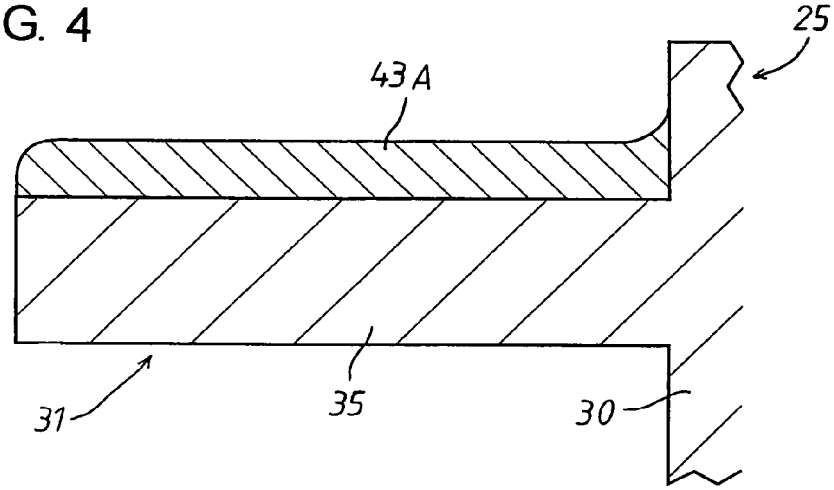
FIG. 4 is an enlarged fragmentary sectional view showing a manufacturing step of applying paste substance to a first base body of the first end surface truing section.

Next, description will be made regarding a method of manufacturing the end surface truing sections 31, 32 and the circumferential surface truing section 33. First of all, metal powder of either group which is selected from the metals of the periodic table group 4A including titanium (Ti), the metals of the periodic table group 5A including vanadium (V) and the metals of the periodic table group 6A including chromium (Cr) is mixed with metal powder of the periodic table group 1B including copper (Cu), silver (Ag) and gold (Au), together with suitable organic binder to be compounded to paste (paste substance) 43A. The paste substance 43A becomes the brazing material 38 when fired. The paste substance 43A is applied by a brush on the external surface of the first base body 35 to an appropriate thickness, as shown in FIG. 4, and the numerous diamond abrasive grains 37 made of synthetic diamond which have been sieved in advance to a predetermined grain size are implanted as a single layer in the paste substance 43A at an almost uniform distribution to make a predetermined concentration of abrasive grains, whereby the bottom portion of each diamond abrasive grain 37 is seated on the external surface of the first base body 35. Likewise, the paste substance 43A is applied to the internal surface of the second base body 39, and the diamond abrasive grains 37 are implanted to be seated thereon. Further, the paste substance 43A is also applied to the left end surface of the third base body 41, and the diamond abrasive grains 37 are implanted to be seated thereon.

Then, the base 30 including the base bodies 35, 39, 41 on each of which the diamond abrasive grains 37 have been retained in the paste substance 43A is put into a firing furnace to be fired at a temperature in a range of 840 through 940 degrees Celsius. This firing is carried out within an atmosphere including an inert gas such as argon gas or the like or in a vacuum in order to prevent the respective metal materials being the ingredients of the grazing material 38 from being oxidized. By this firing, a metalizing film consisting of a carbide (e.g., titanium carbide (TiC)) of one of the metals which belong to the periodic table groups 4A, 5A and 6A is formed on the surface of each diamond abrasive grain 37, whereby the metalizing film becomes easier to melted to the metal which belongs to the periodic table group 1B including copper (Cu), silver (Ag) and gold (Au) and whereby the affinity of each diamond abrasive grain 37 for the brazing material 38 can be enhanced through the intervention of the metalizing film. Because metalizing film formed on the surface of each diamond abrasive grain 37 has a strong affinity for the brazing material in the melting state, the melting brazing material adheres to the surface of each diamond abrasive grain 37 to rise up toward the same, so that the brazing material 38 between the adjoining diamond abrasive grains 37 becomes high at portions contacting with the diamond abrasive grains 37 but low at an intermediate portion therebetween to define a large depression or hollow between the adjoining diamond abrasive grains 37. Further, the first through third base bodies 35, 39, 41 also have a strong affinity for the brazing material 38, so that after cooling, the first, second and circumferential surface truing sections 31 through 33 can be obtained having the first through third abrasive grain layers 36, 40, 42 wherein as shown in FIG. 3, the brazing material 38 adheres to the surface of each diamond abrasive grain 37 to rise up toward the same and wherein the diamond abrasive grains 37 of a single layer is brazed with a strong retention force on each of the first through third base bodies 35, 39, 41.

Next, the operation of the embodiment will be described. When truing is performed on the grinding surface 23*a* of the grinding wheel 20 which is at one end opposite to the main body 27 of the truing tool support device 26, the opposite end surface truing tool 25 is first rotationally driven by the built-in motor 29 in the direction opposite to the rotational direction of the grinding wheel 20. The workpiece table 12 and the wheel head 19 are relatively moved by the respective servomotors 17, 24, and the opposite end surface truing tool 25 is positioned relative to the grinding wheel 20 so that the first end surface truing section 31 is retracted to take a position which is radially outside of the grinding surface 23*a* at one end of the grinding wheel 20 and so that of the end edge of the first end surface truing section 31 protruding from the base 30 toward left, a circumferential portion (the portion closest to the rotational axis O1 of the grinding wheel 5) which protrudes to the leftmost side due to the inclination of the opposite end surface truing tool 25 takes in the first direction a position where it should have been infed a minute amount against the grinding surface 23*a*. Then, the wheel head 19 is advanced by the servomotor 24 in the second direction thereby to relatively move the opposite end surface truing tool 25 toward the rotational axis O1 of the grinding wheel 20 (refer to the state indicated by the sign 46A in FIG. 6). As a result, of the end edge of the first end surface truing section 31, the circumferential edge portion protruding to the leftmost side is brought into contact with the grinding surface 23*a* at one end of the grinding wheel 20 to be moved along the grinding surface 23*a*, whereby the first abrasive grain layer 36 trues the grinding surface 23*a* as it goes ahead of the first base body 35.

When truing is performed on the grinding surface 23*b* at the other end of the grinding wheel 20, the opposite end surface truing tool 25 is rotationally driven by the built-in motor 29 in the same direction as the rotational direction of the grinding wheel 20. The workpiece table 12 and the wheel head 19 are relatively moved by the respective servomotors 17, 24, and the opposite end surface truing tool 25 is positioned relative to the grinding wheel 20 so that of the end edge of the second end surface truing section 32 protruding from the base 30 toward right, a circumferential edge portion (the portion farthest from the rotational axis O1 of the grinding wheel 5) which protrudes to the rightmost side due to the inclination of the opposite end surface truing tool 25 is retracted to take a position which is radially outside of the grinding surface 23*b* at the other end of the grinding wheel 20 and so that the circumferential edge portion protruding the rightmost side of the second end surface truing section 32 is brought into a position in the first direction where it should have been infed a minute amount against the grinding surface 23*b*. Then, the wheel head 19 is advanced by the servomotor 24 in the second direction thereby to relatively move the opposite end surface truing tool 25 toward the rotational axis O1 of the grinding wheel 20 (refer to the state indicated by the sign 46B in FIG. 6). As a result, of the end edge of the second end surface truing section 32, the circumferential edge portion protruding to the rightmost side is brought into contact with the grinding surface 23*b* at the other end of the grinding wheel 20 to be moved along the grinding surface 23*b*, whereby the second abrasive grain layer 40 trues the grinding surface 23*b* as it goes ahead of the second base body 39.

In this way, in the state that the portion of the first or second end surface truing section 31, 32 protruding toward the leftmost or rightmost side is retracted to the position radially outside of the circumferential grinding surface 23*c* of the grinding wheel 20 and is infed the minute amount against the grinding surface 23*a*, 23*b*, the opposite end surface truing tool 25 is relatively moved toward the rotational axis O1 of the grinding wheel 20 to true the grinding surfaces 23*a*, 23*b* at the opposite ends. Therefore, it can be realized to prevent either corner portion of the grinding wheel layer 23 of the grinding wheel 20 from chipping during the truing operation.

Further, in truing the grinding surfaces 23*a*, 23*b* at the opposite ends of the grinding wheel 20, the opposite end surface truing tool 25 is rotated in the opposite direction to, and in the same direction as, the rotational direction of the grinding wheel 20 during the respective truing operations. Thus, relative speeds at the respective contact points between the respective grinding surfaces 23*a*, 23*b* and the respective truing sections 31, 32 become the difference between the respective circumferential speeds, so that the respective truing conditions are made to be almost the same to equalize the sharpness of the grinding surface 23*a* with that of the grinding surface 23*b*.

When truing is performed on the circumferential grinding surface 23*c* of the grinding wheel 20, the opposite end surface truing tool 25 is rotated by the built-in motor 29 in the opposite direction to the rotational direction of the grinding wheel 20. The workpiece table 12 and the wheel head 19 are relatively moved by the respective servomotors 17, 24, and the opposite end surface truing tool 25 is positioned relative to the grinding wheel 20 so that the circumferential truing section 33 is moved to a position where it is slightly spaced from the right end of the circumferential grinding surface 23*c* and where the end surface of the circumferential truing section 33 should have been infed a minute amount against the grinding surface 23*c*. Then, the workpiece table 12 is moved by the servomotor toward left in the Z-direction, whereby the third abrasive grain layer 42 trues the grinding surface 23*c* as it goes ahead of the third base body 41.

As described above, in the first embodiment, each of the truing sections 31 to 33 trues each of the grinding surfaces 23*a*, 23*b*, 23*c* as each of the abrasive grain layer 36, 40, 42 thereof goes ahead of each of the first to third base bodies 35, 39, 41. Thus, the diamond abrasive grains 37 on each abrasive grain layer 36, 40, 42 can be sufficiently cut into the CBN abrasive grains on each grinding surface 23*a*, 23*b*, 23*c*, so that the CBN abrasive grains can be crushed surely to have each grinding surface 23*a*, 23*b*, 23*c* trued to a sharp grinding surface having moderate ruggedness formed thereon. Furthermore, since each abrasive grain layer 36, 40, 42 works for truing with itself being backed up by each base body 35, 39, 41, it can be realized to prevent each abrasive grain layer from being damaged by the truing reaction force or the like.

In addition, since the diamond abrasive grains 37 are fixedly brazed on the cylindrical base bodies 35, 39 with the strong affinity brazing material 38 with themselves protruding a large amount, the thickness of each abrasive grain layer 36, 40 in the radial direction can be made to be thin, and the contact area of the end edge of each abrasive grain layer 36, 40 with each grinding surface 23*a*, 23*b* can be made to be small irrespective of a long contact length therebetween. Therefore, in cooperation of this with the large amount protrusion of the abrasive grains 37, the truing resistance can be made to decrease, and hence, each grinding surface 23*a*, 23*b* can be trued sharply.

Particularly, in the foregoing first embodiment, the diamond abrasive grains 37 in each truing section 31 to 33 constitutes a single layer, and by doing like this, the abrasive grain layer 36, 40, 42 brazed on each base body 35, 39, 41 becomes the smallest in thickness, and the contact area at the contact portion between the end edge of each abrasive grain layer 36, 40, 42 and each grinding surface 23*a* to 23*c* of the grinding wheel 20 becomes small thereby to increase the contact surface pressure, so that the diamond abrasive grains 37 can be cut largely into each grinding surface 23*a* to 23*c*. Therefore, since the ruggedness which is formed on each grinding surface 23*a* to 23*c* immediately after the truing operation is made to be large sufficiently, the sharpness of each trued grinding surface 23*a* to 23*c* of the grinding wheel 20 is increased immediately from after the truing, so that it can be realized to gain desired enhancement in grinding efficiency as well as in workpiece surface quality.

Although in the foregoing first embodiment, the abrasive grain layers 36, 40, 42 are formed by implanting the numerous diamond abrasive grains 37 in the paste substance 43A which is applied on the surface of each base body 35, 39, 41 and then by firing the paste substance 43A, they may be formed by applying the mixture of a suitable quantity of the diamond abrasive grains 37 with the paste substance 43A, to the surface of each base body 35, 39, 41 and then by firing the mixture.

Next, the second embodiment will be described with reference to FIGS. 8 and 9. An opposite end surface truing tool in this second embodiment is as a whole composed, like that shown in the first embodiment, of the disc-like base 30 rotatable about the rotational axis O2, the first end surface truing sections 44 and the second end surface truing section each taking a cylindrical shape and protruding from the circumferential portions at the opposite end surfaces of the base 30 coaxially almost in parallel to the rotational axis O2 and the circumferential truing section taking a disc-like shape and protruding radially coaxially from the external surface of the base 30 in the form of a conical shape which makes the half vertex angle of eighty two (82) degrees with the rotational axis O2. In the first end surface truing section 44 and the second end surface truing section, the diamond abrasive grains 37 in the first abrasive grain layer 47 and the second abrasive layer which are brazed respectively on the external and internal surfaces of the first and second base bodies 35, 39 do not form a single layer as is the case of the first embodiment and differ only in the respect that they form plural layers in the direction of depth. Thus, the following description is addressed to the different respect only.

Figure 8:
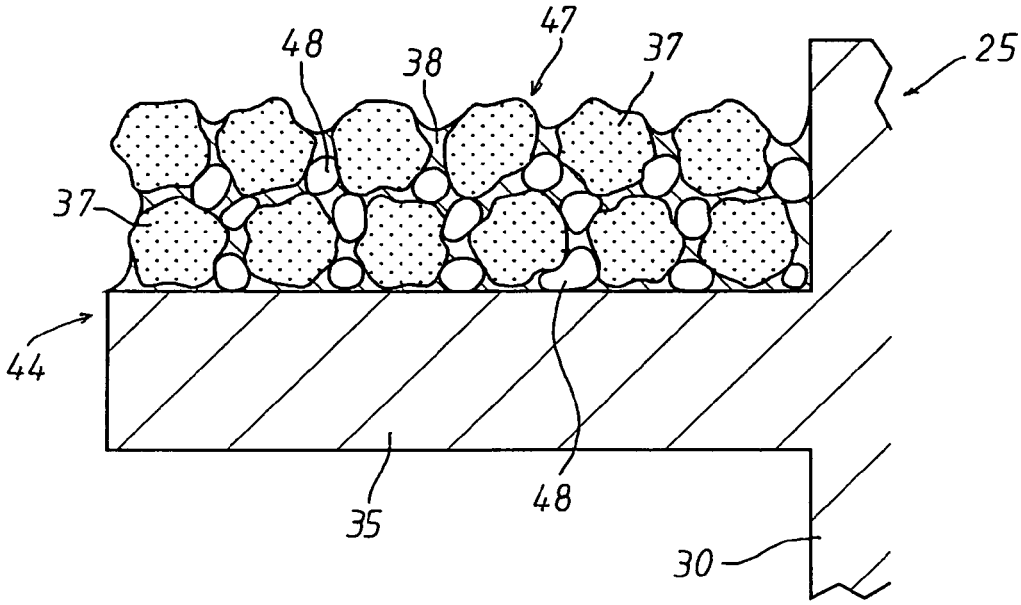
FIG. 8 is an enlarged fragmentary sectional view showing a first end surface truing section of an opposite end surface truing tool in the second embodiment.
Figure 9:
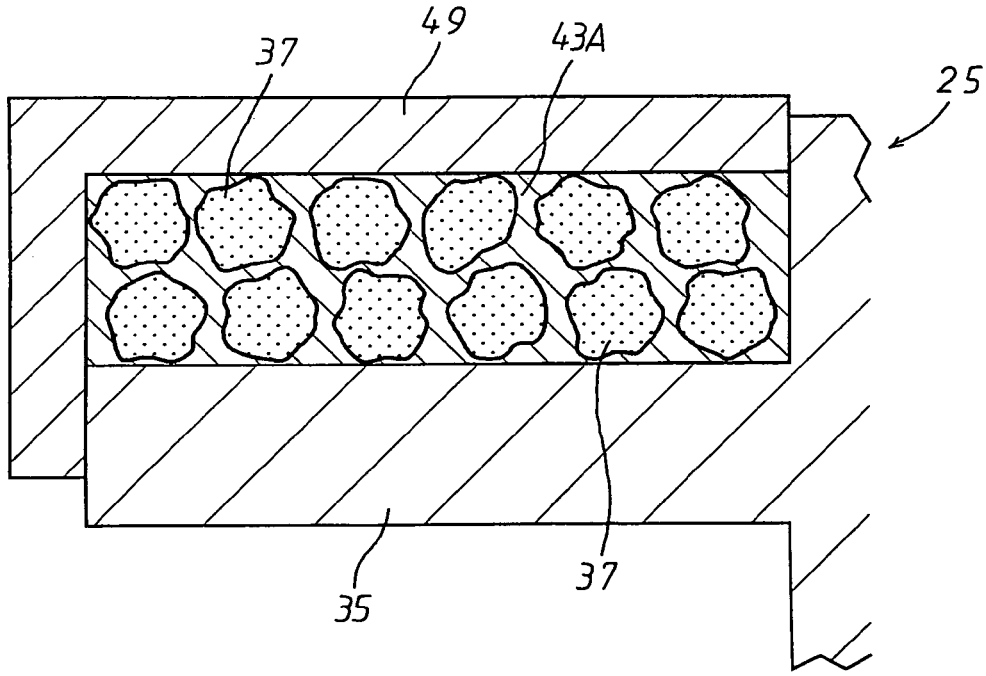
FIG. 9 is an enlarged fragmentary sectional view showing a manufacturing step for the first end surface truing section of the opposite end surface truing tool in the second embodiment.

As shown in FIG. 8, the first abrasive grain layer 47 is formed by brazing numerous diamond abrasive grains 37 with the brazing material which in the melting state has a strong affinity for diamond and is brazed on the external surface of the first base body 35 with the same brazing material 38. The first abrasive grain layer 47 is provided with the diamond abrasive grains 37 arranged in plural layers in the direction of depth, and pores are defined at the positions which are surrounded by the diamond abrasive grains 37 in the brazing material 38. As mentioned earlier, since the metalizing film formed on the surface of each diamond abrasive grain 37 has a strong affinity for the brazing material 38 being in the melting state, the melting brazing material 38 adheres to the surface of each diamond abrasive grain 37 and the first base body 35 with a strong retention force, and spaces among the metal particles gather to define plural pores 48 among the diamond abrasive grains 37. As shown in FIG. 9, the first end surface truing section 44 in this second embodiment is made by covering a mold 49 made of graphite or the like over the external surface of the first base body 35, filling the mixture of an appropriate quantity of the diamond abrasive grains 37 with the paste substance 43A within the space which is defined between the mold 49 and the first base body 35 to have suitable width, firing the mixture and removing the graphite mold 49 after the firing.

Likewise, the second abrasive grain layer (not shown) is formed by brazing the numerous diamond abrasive grains 37 on the internal surface of the second base body 39 with the brazing material 38. The second end surface truing section is made by covering a mold made of graphite or the like over the internal surface of the second base body 39, filling the mixture of an appropriate quantity of the diamond abrasive grains 37 with the paste substance 43A within the space which is defined between the mold and the second base body 39 to have suitable width, firing the mixture and removing the graphite mold after the firing.

The first and second end surface truing sections in this second embodiment make use of plural diamond abrasive grains 37 in truing the grinding surfaces 23*a*, 23*b* at the opposite ends of the grinding wheel 20, the contact area with each grinding surface 23*a*, 23*b* becomes large compared with that in the case of the single layer, nevertheless the abrasion of the diamond abrasive grains 37 decreases to elongate the tool life. It is preferable that the number in the radial direction of the diamond abrasive grains 37 which are brazed on each of the first and second base bodies 35,39 with the brazing material 38 be a small plural number in a range of two to four.

Further, in this second embodiment, even when the diamond abrasive grains 37 at the end edge of each of the first and second end surface truing sections, which respectively true the grinding surfaces 23*a*, 23*b* at the opposite ends of the grinding wheel 20 upon contact therewith, wear out to fall during the truing of each grinding surface 23*a*, 23*b*, the plurality of pores 48 remain formed within the brazing material 38. The diamond abrasive grains 37 can always be kept to protrude a large amount from the brazing material 38 and hence, can be cut sufficiently into and crush the diamond abrasive grains 37 on each grinding surface 23*a*, 23*b* during the truing operation. As a consequence, the trued grinding surfaces 23*a*, 23*b* of the grinding wheel 5 have moderate ruggedness to be sharpened, so that it is ensured to gain desired enhancement in grinding efficiency as well as in workpiece surface quality immediately from after the truing.

Although in the foregoing embodiments, the brazing material 38 having a strong affinity for the diamond abrasive grains 37 is used as bond for adhering the diamond abrasive grains to the external surface, the internal surface and the side surface of the first, second and third base bodies 35, 39 41, there may be used plating metal or sintering material for electrically plating or sintering the diamond abrasive grains 37 to the external surface and the internal surface of the first and second base bodies 35, 39. Further, resin may be used for adhering the diamond abrasive grains 37 to the external surface and the internal surface of the first and second base bodies 35, 39.

Finally, various features and many of the attendant advantages in the foregoing embodiments will be summarized as follows:

In each of the foregoing embodiments typically shown in FIGS. 3, 5, 6 and 8 for example, the first and second end surface truing sections 31 (44), 32 are formed by protruding the cylindrical first and second base bodies 35, 39 from opposite side surfaces of the disc-like base 30 of the opposite end surface truing tool 25 in the axial direction thereof and by providing on the external surface of the first base body 35 and the internal surface of the second base body 39 the first and second abrasive grain layers 36 (47), 40 in which the numerous diamond abrasive grains 37 are adhered with the bond material 38, and the rotational axis O2 of the opposite end surface truing tool 25 is inclined relative to the rotational axis O1 of the grinding wheel 20 within almost the same plane at the predetermined inclination angle. Thus, by moving the opposite end surface truing tool 25 toward the rotational axis O1 of the grinding wheel 20, it can be realized that the first and second abrasive grain layers 36 (47), 40 can respectively true the grinding surfaces 23*a*, 23*b* at the opposite ends of the grinding wheel 20 under almost the same condition to the sharp grinding surfaces having moderate ruggedness, while retaining a sufficient rigidity against the truing resistance as they go ahead of the first and second base bodies 35, 39 to be backed up thereby.

In each of the foregoing embodiments typically shown in FIGS. 3, 5, 6 and 8 for example, the opposite end surface truing tool 25 for truing the grinding surfaces 23*a*, 23*b* at the opposite ends of the grinding wheel 20 has the first and second end surface truing sections 31 (44), 32 formed by protruding the cylindrical first and second base bodies 35, 39 axially from the opposite end surfaces of the disc-like base 30 and by providing the first and second abrasive grain layers 36 (47), 40 in which numerous diamond abrasive grains 37 are adhered with the bond material 38 to the external surface of the first base body 35 and the internal surface of the second base body 39. Thus, by moving the opposite end surface truing tool 25 toward the rotational axis O1 of the grinding wheel 20 with the rotational axis O2 of the truing tool 25 being inclined relative to the rotational axis O1 of the grinding wheel 20 within almost the same plane at the predetermined inclination angle, it can be realized that the first and second abrasive grain layers 36 (47), 40 true the grinding surfaces 23*a*, 23*b* at the opposite ends of the grinding wheel 20 under almost the same condition to the sharp grinding surfaces having moderate ruggedness, while retaining a sufficient rigidity against the truing resistance as they go ahead of the first and second base bodies 35, 39 to be backed up thereby.

Figure 5:
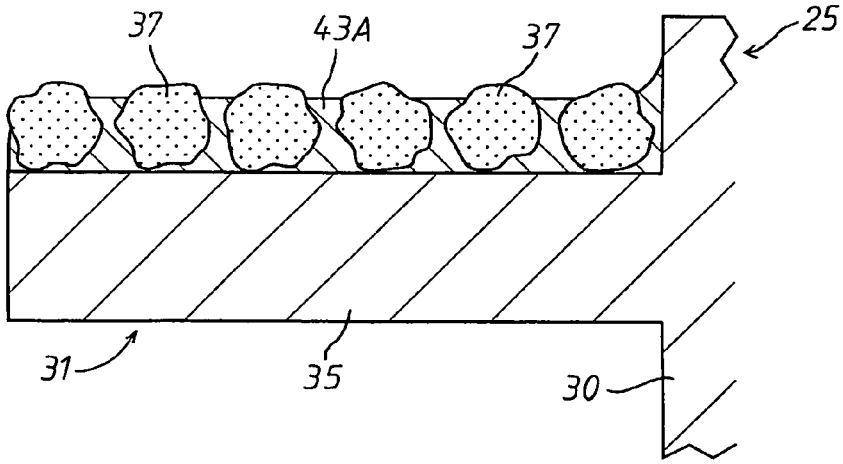
FIG. 5 is an enlarged fragmentary sectional view showing the state that abrasive grains are implanted in the paste substance.

In the foregoing first embodiment typically shown in FIGS. 3, 5 and 6 for example, since each of the abrasive grain layers 36, 40 is a single layer of the diamond abrasive grains 37, each abrasive grain layer 36, 40 in which the diamond abrasive grains 37 are adhered with the bond material 38 to the base body 35 becomes the smallest in thickness, and hence, the contact portion between the end edge of each abrasive grain layer 36, 40 and each grinding surface 23*a*, 23*b* of the grinding wheel 20 becomes the smallest in contact area thereat, so that the diamond abrasive grains 37 can be sufficiently cut into each grinding surface 23*a*, 23*b* of the grinding wheel 20 to crush the abrasive grains surely. Thus, by the truing, the moderate ruggedness can be formed on each grinding surface 23*a*, 23*b*, and each grinding surface 23*a*, 23*b* of the grinding wheel 20 becomes very sharp immediately from after the truing, so that the grinding efficiency and the workpiece surface quality can be enhanced further.

In the foregoing second embodiment typically shown in FIG. 8 for example, brazing material 38 which has a strong affinity for diamond is used as the bond material, and the plurality of pores 48 are formed in the brazing material 38. Thus, even when the truing of each grinding surface 23*a*, 23*b* causes some diamond abrasive grains 37 to fall off each end surface truing section 47, the pores 48 surrounding the remaining diamond abrasive grains 37 ensure that the remaining diamond abrasive grains 37 protrude from the surface of the brazing material 38, and hence, the remaining diamond abrasive grains 37 can be sufficiently cut into each grinding surface 23*a*, 23*b* thereby to crush the abrasive grains on each grinding surface 23*a*, 23*b* surely.

In each of the foregoing embodiments typically shown in FIGS. 6 and 7 for example, since the third abrasive grain layer 42 in which the numerous diamond abrasive grains are adhered with the bond material is provided at one end surface of the disc-like third base body 41 protruding from the external surface of the base 30, it can be realized in addition to the foregoing effects to true the circumferential grinding surface 23*c* of the grinding wheel 20 satisfactorily. Also in the truing of the circumferential grinding surface 23*c* of the grinding wheel 20, the abrasive grains on the grinding surface 23*c* can be crushed sufficiently to have moderate ruggedness, and the grinding surface 23*c* of the grinding wheel 20 becomes sharp immediately from after the truing. Therefore, the grinding resistance can be decreased not to generate any grinding burn on the workpiece surface, so that the grinding efficiency and the workpiece surface quality can be obtained as desired.

In each of the foregoing embodiments typically shown in FIGS. 3, 5, 6 and 8 for example, the opposite end surface truing tool 25 is provided at its opposite ends with the first and second end surface truing sections 31 (44), 32 by protruding the cylindrical first and second base bodies 35, 39 from the opposite ends of the disc-like base 30 and by providing on the external surface of the first base body 35 and the internal surface of the second base body 39 the first and second abrasive grain layers 36 (47), 40 each having the numerous diamond abrasive grains 37 adhered with the bond material 38, the rotational axis O2 of the opposite end surface truing tool 25 is inclined relative to the rotational axis O1 of the grinding wheel 20 within almost the same plane at the predetermined inclination angle, and the opposite end surface truing tool 25 is moved toward the rotational axis O1 of the grinding wheel 20 while being rotated in the opposite direction to, and in the same direction as, the rotational direction of the grinding wheel 20. Thus, the first and second abrasive grain layers 36 (47), 40 at the end edges of the first and second end surface truing sections 31 (44), 32 are moved ahead of the first and second base bodies 35 to be backed up thereby, so that with the retention of a sufficient rigidity against the truing resistance, the grinding surfaces 23*a*, 23*b* at the opposite ends of the grinding wheel 20 can be trued under almost the same condition respectively to the sharp grinding surfaces each having the moderate ruggedness.

INDUSTRIAL APPLICABILITY

The opposite end surface truing device, the opposite end surface truing tool and the opposite end surface truing method according to the present invention are suitable to be used as a truing device, a truing tool and a truing method for truing grinding surfaces at opposite ends of a grinding wheel in a grinding machine wherein a workpiece is ground with the rotating grinding wheel.

The invention claimed is:

1. An opposite end surface truing device for truing grinding surfaces at opposite ends of a grinding wheel with an opposite end surface truing tool by effecting relative movements between the grinding wheel and the opposite end surface truing tool being rotated respectively, in a first direction and a second direction transverse thereto, wherein the opposite end surface truing tool comprises:

a disc-like base supported to be rotatable about a rotational axis thereof, a first end surface truing section composed of a cylindrical first base body which protrudes bodily from a circumferential portion at one end surface of the disc-like base coaxially with the rotational axis of the same and a first abrasive grain layer in which numerous diamond abrasive grains are adhered with bond material to an external surface of the first base body, and a second end surface truing section composed of a cylindrical second base body which protrudes bodily from a circumferential portion at the other end surface of the base coaxially with the rotational axis and a second abrasive grain layer in which numerous diamond abrasive grains are adhered with bond material to an internal surface of the second base body, and wherein the rotational axis of the opposite end surface truing tool is inclined relative to the rotational axis of the grinding wheel within almost the same plane at a predetermined inclination angle.

2. An opposite end surface truing method for truing grinding surfaces at opposite ends of a grinding wheel with the opposite end surface truing device as set forth in claim 1, the method comprising the steps of:

rotating the opposite end surface truing tool in a first rotational direction, moving the opposite end surface truing tool toward the rotational axis of the grinding wheel so that the first abrasive grain layer at an end edge of the first end surface truing section trues the grinding surface at one end of the grinding wheel as it goes ahead of the first base body, rotating the opposite end surface truing tool in a second rotational direction opposite to the first rotational direction, moving the opposite end surface truing tool toward the rotational axis of the grinding wheel so that the second abrasive grain layer at an end edge of the second end surface truing section trues the grinding surface at the other end of the grinding wheel as it goes ahead of the second base body.

3. The opposite end surface truing method as set forth in claim 2, wherein the first and second rotational directions are respectively opposite to, and the same as, the rotational direction of the grinding wheel so that the difference in circumferential speed between the grinding wheel and the opposite end surface truing tool in truing the grinding surface at one end of the grinding wheel is made to be the same as that in circumferential speed therebetween in truing the grinding surface at the other end of the grinding wheel.

4. An opposite end surface truing tool for truing grinding surfaces at opposite ends of a rotating grinding wheel, the truing tool comprising:

a disc-like base supported to be rotatable about a rotational axis thereof, and cylindrical first and second end surface truing sections secured coaxially on circumferential portions at opposite end surfaces of the disc-like base for truing the grinding surfaces at opposite ends of the grinding wheel, wherein the first end surface truing section is composed of a cylindrical first base body which protrudes bodily from a circumferential portion at one end surface of the disc-like base coaxially with the rotational axis of the same and a first abrasive grain layer in which numerous diamond abrasive grains are adhered with bond material to an external surface of the first base body, and wherein the second end surface truing section is composed of a cylindrical second base body which protrudes bodily from a circumferential portion at the other end surface of the base coaxially with the rotational axis and a second abrasive grain layer in which numerous diamond abrasive grains are adhered with bond material to an internal surface of the second base body.

5. The opposite end surface truing tool as set forth in claim 4, wherein each of the abrasive grain layers has a single layer of the diamond abrasive grains.

6. The opposite end surface truing tool as set forth in claim 4, wherein each of the abrasive grain layers has plural layers of the diamond abrasive grains.

7. The opposite end surface truing tool as set forth in claim 4, wherein the bond material is a brazing material having a strong affinity for diamond and wherein a plurality of pores are formed in the brazing material.

8. The opposite end surface truing tool as set forth in claims 4, further comprising:

a disc-like circumferential surface truing section coaxially provided on the external surface of the base for truing a circumferential surface of the grinding wheel, the disc-like circumferential surface truing section being composed of:

a disc-like third base body protruding bodily from the external surface of the base in a radial direction, and a third abrasive grain layer formed on one end surface of the third base body and having numerous diamond abrasive grains adhered with bond material to said one end surface of the third base body.

9. The opposite end surface truing tool as set forth in claims 8, wherein the third base body takes a cone shape having an oblique surface which is inclined relative to the rotational axis of the base.

10. The opposite end surface truing tool as set forth in claims 9, wherein the half vertex angle of the cone shape which is made with the rotational axis of the base is eighty two degrees.

11. An opposite end surface truing method for truing grinding surfaces at opposite ends of a grinding wheel with the opposite end surface truing tool as set forth in claim 4, the method comprising the steps of:

rotating the opposite end surface truing tool in a first rotational direction, moving the opposite end surface truing tool toward the rotational axis of the grinding wheel so that the first abrasive grain layer at an end edge of the first end surface truing section trues the grinding surface at one end of the grinding wheel as it goes ahead of the first base body, rotating the opposite end surface truing tool in a second rotational direction opposite to the first rotational direction, moving the opposite end surface truing tool toward the rotational axis of the grinding wheel so that the second abrasive grain layer at an end edge of the second end surface truing section trues the grinding surface at the other end of the grinding wheel as it goes ahead of the second base body.

12. The opposite end surface truing method as set forth in claim 11, wherein the first and second rotational directions are respectively opposite to, and the same as, the rotational direction of the grinding wheel so that the difference in circumferential speed between the grinding wheel and the opposite end surface truing tool in truing the grinding surface at one end of the grinding wheel is made to be the same as that in circumferential speed therebetween in truing the grinding surface at the other end of the grinding wheel.

* * * * *